US005129301A

United States Patent [19]

Bosche, Jr.

[11] Patent Number: 5,129,301

[45] Date of Patent: Jul. 14, 1992

[54] TRACKER TOUCH APPARATUS UTILIZING MAGNETISM FOR TACTILE FEEL

[75] Inventor: Walwin J. Bosche, Jr., Highland, Ill.

[73] Assignee: The Wicks Organ Company, Highland, Ill.

[21] Appl. No.: 670,683

[22] Filed: Mar. 18, 1991

[51] Int. Cl.[5] ..... G10C 3/12

[52] U.S. Cl. ..... 84/439; 84/440

[58] Field of Search ..... 84/439, 440, 435, 467

[56] References Cited

U.S. PATENT DOCUMENTS

| | | | |
|---|---|---|---|
| 4,217,803 | 9/1980 | Dodds | 84/439 |
| 4,524,669 | 6/1985 | Yamamoto et al. | 84/435 |
| 4,899,631 | 2/1990 | Baker | 84/439 |

*Primary Examiner*—W. B. Perkey
*Assistant Examiner*—Cassandra Spyrou
*Attorney, Agent, or Firm*—Rogers, Howell & Haferkamp

[57] ABSTRACT

A tracker touch apparatus used with a keyboard apparatus having a plurality of selectively depressed keys includes at least one strip magnet support by the apparatus in a position transversing over the tops of the keys. A metal plate is secured to the top of each key of the keyboard in a position just below the strip magnet. Initial depression of a keyboard key is resisted by the magnetic attractive force of the strip magnet for the metal plate secured to the depressed key. The magnetic resistance to keyboard key depression imparts to the keys a desired "feel" of depression.

19 Claims, 1 Drawing Sheet

TRACKER TOUCH APPARATUS UTILIZING MAGNETISM FOR TACTILE FEEL

BACKGROUND OF THE INVENTION (1) Field of the Invention

The present invention relates to a tracker touch apparatus for use with a keyboard having a plurality of selectively depressed keys. In particular, the present invention relates to a magnetic tracker touch apparatus employed with the keyboard of a musical instrument. The apparatus magnetically resists the depression of keys of the keyboard and thereby simulates in keyboard keys of an electrically operated musical instrument the feel of keyboard keys of a mechanically operated musical instrument.

(2) Description of the Related Art

In prior art mechanically operated organs such as pipe organs, the keys of the organ keyboard have a certain "feel" to the organist depressing the keys. The particular "feel" of pipe organ keys is primarily due to the mechanical connection of the keys to valves of the organ that control the selective supply of pressurized air to organ pipes actuated by the keys. With the keyboard keys in their at rest position, the valves disrupt communication between the source of pressurized air and the organ pipes and air pressure backs up behind the valves. By depressing a keyboard key, the valve mechanically connected to the key is moved against the backed up air pressure to a position where it no longer disrupts communication between the air pressure and the organ pipe operated by the valve. As the valve initially moves to communicate the source of air pressure with the organ pipe, it must first overcome the air pressure backed up against the valve. This gives the organist a particular "feel" of resistance to depression as the organ key is first depressed. As the organ key is further depressed, the valve operated by the key overcomes the initial resistance of the backed up air pressure and permits communication between the air pressure source and the organpipe operated by the valve. The overall result is a feeling of initial resistance to depression of the key, and then a noticeable reduction in resistance as the key is depressed further downward. The "feel" in the keys of initial resistance to depression, and then release of the resistance after initial depression is preferred by many keyboard musicians.

In prior art keyboard musical instruments that are operated electronically and do not employ the mechanical connections between the keyboard keys and pipe organ valves, depression of the keyboard keys does not have the "feel" associated with prior art musical instruments having mechanical connections between the keyboard keys and pipe organ valves. In prior art musical instruments of this type, tracker touch systems have been employed to simulate the "feel" of keyboard keys mechanically connected to pipe organ valves. Prior art tracker touch systems have been known to employ coil springs and leaf springs in a variety of arrangements to simulate the desired "feel" of prior art mechanical keyboards. Examples of these types of tracker touch systems are disclosed in U.S. Pat. No. 3,680,426 and No. 4,479,415.

Disadvantages often encountered with these prior art tracker touch systems include the failure of the coil and leaf springs after a period of time. With repeated use of these prior art systems, the coil and leaf springs employed often lose some of their resiliency. As a result, the resistance to depression that produces the desired "feel" of the keyboard keys is lessened, in some cases to the extent where the key offers no resistance at all to depression. In some cases the coil or leaf springs will fail completely by breaking after repeated use over a period of time.

It is an object of the present invention to provide a unique tracker touch apparatus that produces a desirable "feel" when depressing keyboard keys without relying on leaf springs or coil springs.

It is a further object of the present invention to provide a tracker touch apparatus that requires no external source of power.

It is a further object of the present invention to provide a tracker touch apparatus that is adjustable so that the magnitude of the resistance to depression of the keyboard keys caused by the tracker touch apparatus can be adjusted to a desired magnitude.

It is a further object of the present invention to provide a tracker touch apparatus that employs no moving parts and is therefore not subject to wear or fatigue failure over a period of use.

SUMMARY OF THE INVENTION

The tracker touch apparatus of the present invention provides a simplified mechanical device having no moving parts. The apparatus is an improvement over much more complicated electronic and mechanical devices of the prior art having moving parts subject to failure.

Generally, the tracker touch apparatus of the invention is comprised of an elongate metal bar, a plurality of elongate strip magnets, and a plurality of metal plates. The apparatus is installed between the faceboard of a keyboard instrument and the top surfaces of the instrument's keyboard keys. The apparatus is designed to be installed in keyboard instruments as they are originally assembled. However, the apparatus may also be retrofit to existing keyboard instruments.

The elongate metal bar is formed from a thin metal strip having a length that is substantially equal to the transverse width of the musical instrument keyboard keys. This enables the metal bar to lay transversely across the top surfaces of all of the keys of the keyboard. The length of the metal bar will vary for tracker touch apparatus used in keyboard musical instruments having different numbers of keys.

The plurality of metal plates include identical metal plates for each key of the keyboard instrument. In the preferred embodiment of the invention, the metal plates each have a thickness that is substantially equivalent to the thickness of the key cover secured over the keyboard keys. The width of the plates is substantially equal to the width of the keyboard keys, and the length of the plates is about equal to their width, although they may be longer if so desired.

Each of the plurality of metal plates is secured to a top surface of each of the keys of the keyboard. The plates are secured in a position on the keys that is just behind the faceboard of the musical instrument. In this position, the faceboard covers the metal plates and shields them from view. The metal plates may be glued to the top surfaces of the keys, or may be secured to the top surface of the keys in any other equivalent manner.

The plurality of elongate strip magnets are laid over one side of the elongate metal bar. The magnets have substantially the same length as the metal bar and have widths dimensioned so that several of the magnets may be laid parallel and side-by-side on the one side of the metal bar. The strip magnets are held to the bar by the magnetic field produced by the plurality of magnets. The bar and the magnets are wrapped in a one-layer cloth covering and the cloth covering is left open at the opposite ends of the bar and magnets to provide access to the magnets inside the covering.

The wrapped bar and magnets lay transversely across the plurality of metal plates secured to the top surfaces of the keyboard keys. The wrapped bar and magnets are laid transversely across the metal plates secured to the tops of the keyboard keys and are supported by the keys.

With the elongate bar and strip magnets so positioned, the magnetic force produced by the strip magnets attracts the metal plates secured to the top surfaces of the keyboard keys to the magnets. When one or more of the keyboard keys are depressed, the magnetic force of the plurality of strip magnets exerts an attractive force on the metal plates of the depressed keys that produces an initial resistance to depression of the keys. As the keys are depressed further, the magnetic attractive force decreases rapidly until it reaches a point where it produces no resistance to depression of the keys. In this manner, the tracker touch apparatus of the present invention produces the desired "feel" in the depression of the keyboard keys.

If the resistance to key depression produced by the apparatus is found to be too great, the force may be lessened by removing one or more strip magnets of the plurality of strip magnets held to the metal bar. The opposite ends of the cloth wrapping surrounding the metal bar and strip magnets are left open for this purpose. Through an opened end of the cloth wrapping one or more of the strip magnets may be pulled from their positions against the one side of the metal bar.

The strip magnets are completely removed from the metal bar one at a time until the desired tracker touch "feel" is achieved. The strip magnets are constructed of flexible materials that facilitate the removal of the magnets from the metal bar and the cloth wrapping. The flexibility of the strip magnets also permits some deflection of the magnets from the metal bar, enabling portions of the magnets to deflect downward and travel with the metal plate of a depressed keyboard key. The limited deflection of the strip magnets with the depressed keyboard keys enhances the desired "feel" of the keys.

The cloth wrapping of the metal bar and plurality of strip magnets provides a cushion between the plurality of strip magnets and the plurality of metal plates secured to the tops of the keyboard keys. The cloth wrapping cushion prevents a tapping noise when the metal plates of the keys return upward and engage the underside of the apparatus.

BRIEF DESCRIPTION OF THE DRAWINGS

Further objects and features of the present invention are revealed in the following detailed description of the preferred embodiments of the invention and in the drawing figures wherein.

DESCRIPTION OF THE PREFERRED EMBODIMENT

Figure 1:
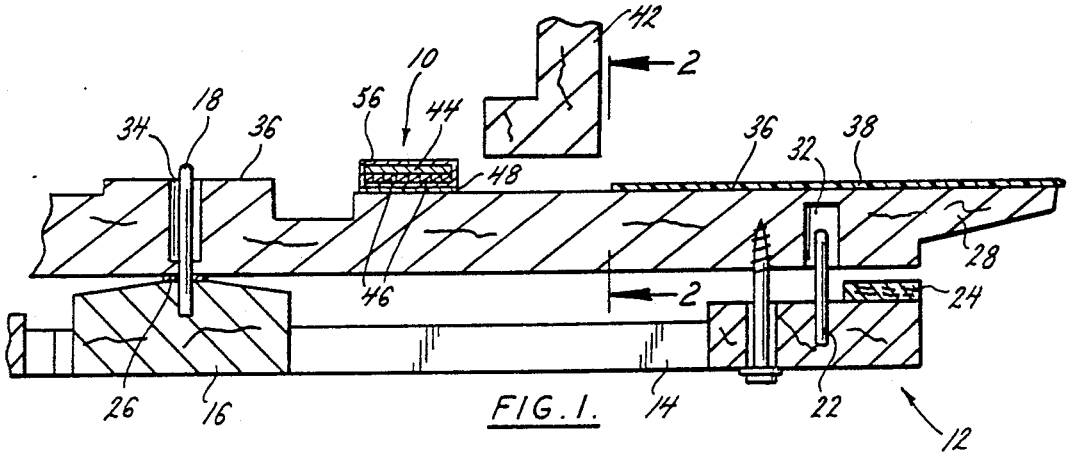
FIG. 1 is a side elevation view in section of the tracker touch apparatus of the present invention.
Figure 2:
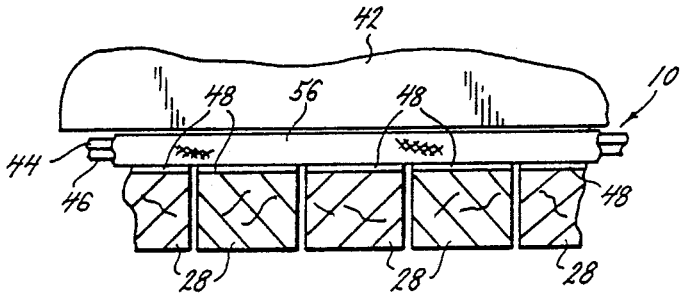
FIG. 2 is a segment of a front elevation view in section of the tracker touch apparatus taken along the line 2—2 of FIG. 1.

FIG. 1 shows the tracker touch apparatus of the present invention 10 installed on a keyboard of a conventional keyboard musical instrument 12. Although only one key of the keyboard is shown, it should be understood that the positioning and operation of the tracker touch apparatus 10 with respect to the shown keyboard key is the same for all keys of the keyboard.

The keyboard 12 comprises a keybed frame 14 supporting a fulcrum 16. The fulcrum 16 is provided at the rearward end of the keybed frame 14 and a pivot pin 18 extends vertically upward from the fulcrum. At a forward end of the keybed frame 14, a guide pin 22 that extends vertically upward is secured to the frame. A damping cushion 24 is secured to the forward most edge of the keybed frame 14. A sound damping felt washer 26 is positioned around the pivot pin 18 and resting on the top surface of the fulcrum 16.

A keyboard key 28 rests on the felt washer 26 on the fulcrum 16 and is held in position by the guide pin 22 and the pivot pin 18. The keyboard key 28 is provided with a first slot 32 in its underside at a forward end of the key, and a second slot 34 extending downward from the key top surface 36 at a rearward end of the key. A hole is provided at the bottom of the second slot 34 and the pivot pin 18 extends upward through the hole and into the slot. The pivot pin's extending through the hole and into the second slot provides the pivoting connection of the keyboard key 28 on the fulcrum 16 of the keybed frame 14. The guide pin 22 extends upward from the keybed frame 14 into the forward first slot 32. The pivot pin 18 and the guide pin 22 permit the up and down pivoting movement of the forward end of the key 28 on the fulcrum 16 while preventing side-to-side movement of the key 28, thereby maintaining all of the keys in the keyboard parallel to each other while permitting the keys to be depressed downward.

The top surface 36 of the keyboard key 28 at the forward end of the key is covered by a key cover 38. The key covers 38 on a conventional keyboard are provided in black and white, a white key cover being shown in FIG. 1. The key covers 38 extend back on the keys 28 to the faceboard 42 of the instrument so that the portions of the keys top surfaces not covered by the key covers are not visible.

The component parts of the musical instrument keyboard keys described up to this point are conventional. Each of the described component parts, or a functional equivalent thereof, are employed in most conventional keyboard musical instruments. The mechanical connection of the white keyboard keys and the black keyboard keys to the keybed frame 14 is substantially the same and is substantially as shown in FIG. 1. Although the described component parts may vary slightly from one instrument to another, they are substantially identical and function substantially the same. Although the tracker touch apparatus 10 of the invention is disclosed as being employed with the particular keyboard structure shown in FIG. 1, it should be understood that the tracker touch apparatus may be employed in all keyboards having a plurality of keyboard keys arranged parallel to each other and having coplanar top surfaces and not just in the particular musical instrument keyboard shown.

A preferred embodiment of the tracker touch apparatus is generally comprised of an elongate metal bar 44, a plurality of flexible strip magnets 46, and a plurality of thin metal plates 48.

The elongate metal bar 44 is formed from a thin metal strip having opposite ends 52 and a length between its opposite ends 52 that is substantially equal to the transverse width of the musical instrument keyboard keys 28. This enables the metal bar 44 to lay transversely across the top surfaces 36 of all of the keys 28 of the keyboard. The length of the metal bar 44 will vary for tracker touch apparatus used in keyboard musical instruments having different numbers of keys.

Figure 3:
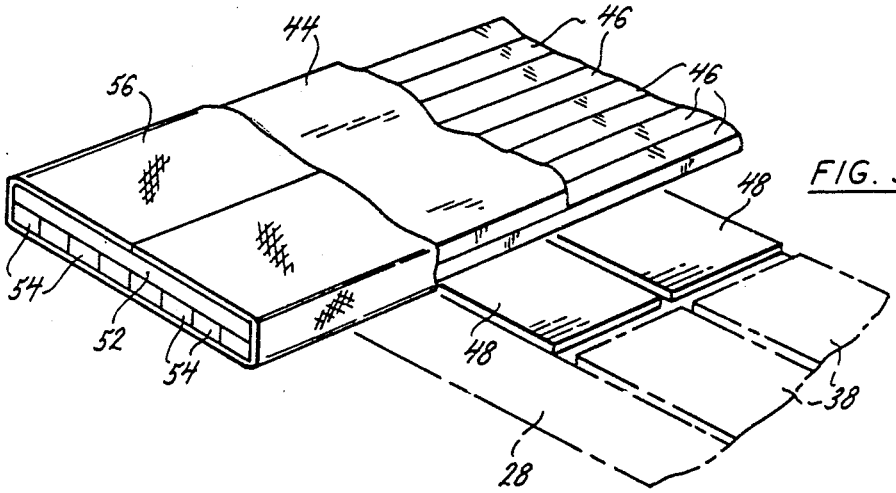
FIG. 3 is a segment of a perspective view of the tracker touch apparatus in its operative position extending transversely over the plurality of keys of a keyboard musical instrument.

The plurality of flexible strip magnets 46 are all substantially identical and are all constructed from strips of flexible magnetic material. Each of the plurality of magnetic strips 46 has opposite ends 54 and a length between its opposite ends 54 that is substantially equal to the length of the elongate metal bar 44. The width of each of the individual strip magnets 46 is determined to enable an integral number of strips to be positioned side-by-side against the underside of the metal bar 44 as is best seen in FIG. 3. The magnetic attractive force of the plurality strip magnets 46 holds the magnets to the bar 44. The plurality of strip magnets are constructed from a flexible magnetic material in order to facilitate deflection of the strips and to facilitate their selective removal from their positions under the metal bar 44 in a manner to be described. Each of the plurality of strip magnets are magnetically held to the underside of the metal bar with the ends 54 of the magnets aligned with the ends 52 of the bar and the opposite side edges of the plurality of magnets aligned with the side edges of the bar. The metal bar 44 enhances the magnetic attraction of the plurality of strip magnets 46 for the plurality of metal plates 48. In alternate embodiments of the invention the plurality of strip magnets may be employed without the elongate metal bar. In a further alternate embodiment of the invention one wide strip magnet may be employed in lieu of the plurality of thinner strip magnets. This embodiment of the invention would not have the capability of adjusting the magnetic attractive force such as the embodiment being described.

The plurality of metal plates 48 are all formed from a thin sheet of metal having a thickness substantially equal to the thickness of the key cover 38. Each of the individual metal plates 48 is formed in a general rectangular configuration with a width substantially equal to the width of the keys 28 of the keyboard and a length substantially equal to the width of the elongate metal bar 44. In the tracker touch apparatus, a metal plate 48 is provided for each key of the musical instrument keyboard.

The elongate metal bar 44 and the plurality of flexible strip magnets 46 held magnetically to the underside of the bar are wrapped in a single layer of cloth 56. The cloth layer 56 is left open at the opposite ends of the metal bar 52 and strip magnets 54 to provide access to the individual strip magnets. The cloth wrapping 56 provides a sound damping insulator between the plurality of strip magnets 46 and the plurality of metal plates 48 and prevents a tapping sound when the metal plates 48 contact the underside of the strip magnets 46.

The tracker touch apparatus 10 is assembled to the keyboard 12 of the musical instrument in the position shown in FIG. 1. In assembling the tracker touch apparatus 10 to the musical instrument keyboard, the plurality of metal plates 48 are first secured to the top surfaces 36 of each of the keys 28. The metal plates may be secured to the keys by gluing or by other equivalent means. The plates are secured to the keys in the positions shown in the drawings directly behind the faceboard 42 of the musical instrument and with each of the separate plates being arranged side-by-side traversing the keyboard keys of the instrument. By placing the metal plates 48 behind the faceboard 42 of the instrument the faceboard conceals the plates from sight.

In an alternate embodiment of the invention, metal keyboard keys are employed in lieu of the wooden keys shown. In this embodiment of the invention the metal keys themselves are attracted to the metal bar and strip magnets and there is no need to attach a plurality of metal plates to each of the individual keys.

Next, the elongate metal bar 44 and the plurality of strip magnets 46 wrapped in the cloth cover 56 are positioned over the plurality of metal plates 48. The length of the metal bar 44 and strip magnets 46 extends transversely over all of the plurality of keys 28 and the plurality of metal plates 48 secured to the top surfaces of the keys. The metal bar 44 and strip magnets 46 lay over the metal plates 48 on the top surfaces of the keys. The keys themselves support the metal bar and strip magnets. As one keyboard key 28 is depressed, the keyboard keys on opposite sides of the depressed key along with the remaining keyboard keys that have not been depressed support the metal bar 44 and the strip magnets 46 above the depressed key.

The metal bar 44 extends transversely across the plurality of keyboard keys 28 in a position just behind the faceboard 42 of the musical instrument. The plurality of strip magnets 46 extend side-by-side along the bottom surface of the metal bar 44 and are held to the metal bar 44 by the magnetic field produced by the strip magnets. One layer of the cloth wrapping 56 next extends below the plurality of strip magnets 46. The plurality of metal plates 48 secured to the keyboard keys 28 engage the underside of the portion of the cloth cover 56 stretched beneath the plurality of strip magnets 46. By constructing the tracker touch apparatus of the invention and assembling it to the musical instrument keyboard in the manner discussed above, the strip magnets 46 are positioned directly above the metal plates 48 secured to the keyboard keys. The magnetic field produced by the individual magnetic strips 46 is enhanced by the metal bar 44 positioned above the magnets, and the magnetic field attracts each of the plurality of metal plates 48 secured to the keyboard keys. The magnetic force attracting the metal plates 48 to the strip magnets 46 creates a resistance to any depression of the keyboard keys 28 that would cause the metal plates 48 to be separated from the plurality of strip magnets 46. This resistance to the depression of the keyboard keys gives each of the keyboard keys the desired tracker touch "feel".

If after having been installed in the keyboard of the musical instrument it is discovered that the tracker touch apparatus produces too great a force resisting depression of the keyboard keys, the tracker touch "feel" of the apparatus may be adjusted. The open ends of the cloth covering 56 are provided to enable adjusting the magnitude of the magnetic attractive force produced by the plurality of strip magnets 46 and exerted on the plurality of metal plates 48. From the open end of the cloth cover 56 an end 54 of one of the strip magnets 46 is grasped by a gripping tool, and then is pulled out from its position under the elongate metal bar 44. Because the magnetic field produced by the strip magnets 46 holds the strip magnets to the underside of the metal bar 44, an entire strip magnet 46 can be pulled from its position beneath the metal bar 44 through the open end of the cloth cover 56. By selectively removing one strip magnet at a time the magnitude of the magnetic attractive force exerted by the plurality of strip magnets 46 on the metal plates 48 may be adjusted.

By constructing the strip magnets 46 from a flexible magnetic material the removal of the individual strip magnets from beneath the installed metal bar 44 is facilitated. Moreover, by providing a thin, flexible metal bar 44 and constructing the plurality of strip magnets from a flexible magnetic material, the portions of the strip magnets directly above a depressed keyboard key are capable of deflecting downward slightly to follow the metal plate 48 secured to the top surface of the depressed key as it travels away from the plurality of strip magnets. This limited deflection of the strip magnets enhances the initial resistance to depression felt while depressing the key. The flexibility of the metal bar 44 and the flexibility of the plurality of strip magnets 46 also compensate for the warping of keyboard keys and enables the strip magnets to maintain contact with the metal plates of warped keys.

While the present invention has been described with reference to specific embodiments, it should be understood that modifications and variations of the invention may be constructed without departing from the scope of the invention defined in the following claims.

What is claimed is:

1. A tracker touch apparatus for use with a keyboard apparatus having a plurality of selectively depressed keys, the tracker touch apparatus comprising:

first means producing a magnetic field, the first means extending transverse to the plurality of keys; and second means secured to at least one key of the plurality of keys, the second means being magnetically attracted to the first means by the magnetic field produced by the first means, and the magnetic attraction of the second means to the first means resisting depression of the one key.

2. The apparatus of claim 1, wherein:

the first means is supported by the keyboard apparatus extending transversely above the plurality of keys.

3. The apparatus of claim 1, wherein:

the first means lays transversely over the plurality of keys and is supported by the plurality of keys.

4. The apparatus of claim 1, wherein:

the second means includes a plurality of metal plates, each plate of the plurality of plates being secured to a key of the plurality of keys.

5. The apparatus of claim 4, wherein:

each plate of the plurality of plates is secured to a top surface of a key of the plurality of keys;

and the first means is supported by the keyboard apparatus above the plurality of plates secured to the plurality of keys and exerts a magnetic attractive force on the plurality of plates.

6. The apparatus of claim 4, wherein:

the first means includes at least one strip magnet extending transversely over the plurality of metal plates secured to the plurality of keys.

7. The apparatus of claim 4, wherein:

the first means includes a metal bar supported by the keyboard apparatus and extending transversely over the plurality of keys, and at least one strip magnet extending transversely over the plurality of keys and held to the metal bar by a magnetic attractive force produced by the strip magnet, the strip magnet exerting a magnetic attractive force on the plurality of plates fixed to the plurality of keys.

8. The apparatus of claim 7, wherein:

the magnetic means includes a plurality of strip magnets extending transversely over the plurality of keys and held to the metal bar by a magnetic attractive force produced by the plurality of strip magnets, the plurality of strip magnets exerting a magnetic attractive force on the plurality of plates fixed to the plurality of keys.

9. The apparatus of claim 8, wherein:

each of the strip magnets of the plurality of strip magnets is adapted to be removed from being held to the metal bar and from extending transversely over the plurality of keys to thereby adjust the magnetic attractive force exerted on the plurality of metal plates secured to the plurality of keys.

10. A tracker touch apparatus for use with a keyboard apparatus having a plurality of selectively depressed keys, the tracker touch apparatus comprising:

magnetically attracted means secured to at least one key of the plurality of keys; and, magnetic field producing means supported by the keyboard apparatus extending transverse to the plurality of keys, the magnetic field producing means exerting a magnetic attractive force on the magnetically attracted means secured to at least the one key, the magnetic field producing means being adjustable to vary the magnitude of the magnetic attractive force exerted by the magnetic field producing means on the magnetically attracted means, and the magnetic field producing means includes at least one strip magnet supported by the keyboard apparatus extending transverse to the plurality of keys.

11. The apparatus of claim 10, wherein:

the magnetic field producing means includes a plurality of strip magnets supported by the keyboard apparatus extending transverse to the plurality of keys, each strip magnet of the plurality of magnets being removable from the keyboard apparatus to adjust the magnitude of the magnetic attractive force exerted by the magnetic field producing means.

12. The apparatus of claim 10, wherein:

the magnetic field producing means includes a metal bar supported by the keyboard apparatus extending transversely over the plurality of keys, and a plurality of strip magnets extending transversely over the plurality of keys and held to the metal bar by a magnetic attractive force produced by the plurality of strip magnets, the plurality of strip magnets exerting a magnetic attractive force on the magnetically attracted means.

13. The apparatus of claim 12, wherein:

each of the strip magnets of the plurality of strip magnets is adapted to be removed from being held to the metal bar and from extending transversely over the plurality of keys to thereby adjust the magnetic attractive force exerted on the magnetically attracted means.

14. The apparatus of claim 10, wherein:

the magnetically attracted means includes a plurality of metal plates, each plate of the plurality of metal plates is secured to a key of the plurality of keys.

15. A tracker touch apparatus for use with a keyboard assembly having a plurality of selectively depressed keys, the apparatus comprising:

first means supported by the keyboard assembly in a position extending transverse to the plurality of keys;

second means secured to each of the keys of the plurality of keys;

one of the first and second means producing a magnetic field and the other of the first and second means being magnetically attracted to the one of the first and second means by the magnetic field produced by the one of the first and second means, the magnetic attraction of the other of the first and second means to the one of the first and second means resisting depression of the plurality of keys.

16. The apparatus of claim 16, wherein:

the one of the first and second means is a plurality of magnets, each magnet of the plurality of magnets is removable from the tracker touch apparatus to adjust the magnitude of the magnetic attraction of the other of the first and second means to the one of the first and second means.

17. The apparatus of claim 15, wherein:

the first means is supported by the keyboard assembly in a position extending transversely above the plurality of keys.

18. The apparatus of claim 17, wherein:

each key of the plurality of keys has a top surface, the second means is secured to the top surface of each key of the plurality of keys, and the first means is supported by the keyboard assembly above the second means.

19. The apparatus of claim 15, wherein:

the first means is a plurality of magnets removably supported by the keyboard assembly and extending transverse to the plurality of keys;

the second means is a plurality of metal plates, each metal plate of the plurality of metal plates being secured to a key of the plurality of keys;

the plurality of metal plates being magnetically attracted to the plurality of magnets by a magnetic field produced by the plurality of magnets, and the magnetic attraction of the plurality of metal plates to the plurality of magnets being adjusted by selectively removing magnets from the plurality of magnets.

* * * * *